US005089069A

United States Patent [19]

Ramaswamy et al.

[11] Patent Number: 5,089,069

[45] Date of Patent: Feb. 18, 1992

[54] GAS GENERATING COMPOSITION FOR AIR BAGS

[75] Inventors: Coodly P. Ramaswamy, Christiana, Pa.; Francis Souriraja, Parsippany, N.J.

[73] Assignee: Breed Automotive Technology, Inc., Boonton Township, Morris County, N.J.

[21] Appl. No.: 542,313

[22] Filed: Jun. 22, 1990

[51] Int. Cl.[5] ..... C06B 45/02

[52] U.S. Cl. ..... 149/21; 149/35; 149/61; 149/110; 149/112

[58] Field of Search ..... 149/35, 21, 61, 110, 149/112

[56] References Cited

U.S. PATENT DOCUMENTS 4,021,275 5/1977 Kishi et al. ..... 149/35

4,547,235 10/1985 Schneiter et al. ..... 149/35

*Primary Examiner*—Stephen J. Lechert, Jr.

*Attorney, Agent, or Firm*—Kane, Dalsimer, Sullivan, Kurucz, Levy, Eisele and Richard

[57] ABSTRACT

The invention disclosed herein is a gas generating composition suitable for use in air bag systems. The gas generating composition is comprised of a solid metal azide as a fuel, an alkali nitrate as an oxidizer, and diatomaceous earth as an additive.

3 Claims, No Drawings

GAS GENERATING COMPOSITION FOR AIR BAGS

FIELD OF THE INVENTION

Disclosed herein is a gas generating composition suitable for use in an automobile air bag system.

BACKGROUND OF THE INVENTION

Automobile air bags systems are recognized as the best means to prevent trauma in an automobile accident. Designed to deploy when a vehicle travelling at velocities of 12 m.p.h. or greater experiences a sudden impact, the air bag inflates with a non-toxic gas to form a soft barrier, preventing occupant impact with the automobile interior or windshield. Thus, serious injuries are averted.

Air bags systems have been disclosed in patents as early as the 1950's. By the 1970's such systems were included in Ford, General Motors and Volvo automobiles. Passengers of those vehicles who became involved in accidents were spared serious injury by deployment of the system, conclusively proving the system's beneficence.

The typical air bag system is generally comprised of a sensor that sets off an explosive train, in which the last component is a gas generating device. The gas generating device contains a gas generating composition (a/k/a inflator). The sensor, which operates on mechanical or electro-mechanical principles, senses the energy generated by the crash. Energy is transferred to the sensor starts the explosion train. The gas generating composition rapidly inflates the bag with a non-toxic gas.

The two important components of the airbag system are the sensing device and the gas generating composition. The sensing device, which picks up the energy of the automobile crash and sets off the explosive train, can be either an electromechanical device with a diagnostic system or a mechanical device. A variety of gas generating compositions have been developed to fill the airbag. One of the earliest was that developed by Dow Chemical based on Oxamide as fuel and potassium perchlorate as the oxidizer, along with a coolant, which generated a gas containing 85% carbon dioxide and 13% nitrogen (Proceedings of 3rd International Pyrotechnics Seminar, Denver Res. Institute, Colorado 1972). A number of patents disclose the gas generating compositions, where the non-toxic gas filling the airbag is carbon dioxide. See e.g., U.S. Pat. Nos. 3,532,357, 3,647,353, 3,964,255 and 3,971,729. However, utilizing carbon-dioxide as the airbag-filling gas has not been accepted by the automobile industry, probably due to the fact that incipient oxidation may result in formation of carbon-monoxide, potentially a health hazard at 400 ppm levels. Hence, most of the development has been based on the use of metallic azides in combination with an oxidizer, where the gas generated to fill the airbag is nitrogen. There are numerous patents covering the use of metallic azides for gas generating compositions:

U.S. Pat. No. 3,741,585 discloses the use of metallic azides with metallic sulfides, iodides, oxides and sulfur to generate low temperature nitrogen gas generating composition.

U.S. Pat. No. 3,936,300 discloses the use of sodium azide as the fuel and potassium chlorate as the oxidizer, along with other additives, for the gas generating composition in airbags.

U.S. Pat. No. 3,947,300 discloses the use of sodium azide as the fuel, potassium nitrate as the oxidizer, along with silicon dioxide for slagging out the product of reaction for gas generating composition to be used in airbags. The preferred proportion in which the fuel, oxidizer and slagging agent are to be used are 5:1:2 to 10:1:5. The other oxidizers mentioned in the patent are sodium nitrate, magnesium nitrate, calcium nitrate, sodium perchlorate and potassium perchlorate and the other fuels mentioned are potassium azide and calcium azide.

U.S. Pat. No. 4,547,235 discloses the use of sodium azide in combination with potassium nitrate (an oxidizer) along with silicon dioxide, molybdenum sulfide and sulfur for the gas generating composition in airbags.

U.S. Pat. No. 4,604,151 discloses the use of an alkali metal azide, along with a mixture of metal oxides including manganese dioxide, iron oxide and nickel oxide. The combination of the metal oxides and ammonium perchlorate generate nitrogen gas for airbags.

U.S. Pat. No. 4,696,705 discloses the use of sodium azide in combination with iron oxide, sodium nitrate (as an oxidizer), bentonite, fumed silica, and graphite fibers to generate nitrogen gas to inflate airbags.

U.S. Pat. No. 4,734,141 discloses the use of sodium azide and an oxidizer consisting of bimetallic complexes containing copper or iron in combination with chromium, molybdenum or tungsten and a lubricant like magnesium stearate for generating non-toxic nitrogen gas for the airbags.

U.S. Pat. No. 4,806,180 discloses a gas generating composition for use in airbags consisting of a metal azide (30–50%) sodium nitrate or potassium perchlorate (40–60%) along with Boron 5–15%) and sodium silicate (1–15%).

SUMMARY OF THE INVENTION

Ideally, a gas generating composition should possess the following characteristics. It should be in solid form, capable of being formed into pellets. It should be easy to handle and non-toxic so as to provide a safe manufacturing process. It must not be hygroscopic, as it is likely that the system shall remain dormant for an extended time period. If moisture is absorbed the result can be de-sensitization of the system. The components must not be unduly toxic, thereby preventing safe handling during manufacture. Upon combustion, the composition should produce a predominantly non-toxic gas and the level of residual gaseous impurities must be acceptable when compared to industrial hygiene standards. Finally, the solid residue formed during the gas generating reaction should not form an aerosol of toxic nature, but should be capable of being arrested by the filters included in the inflator system.

It is an object of the present invention to provide a gas generating system which meets the above requirements.

It is a further object to provide a gas generating composition which can be used in the aforedescribed air bag systems.

The composition disclosed herein is comprised of a fuel that generates a non-toxic gas upon decomposition, an oxidizer which aids in igniting the fuel at low temperatures, and an additive that combines with the products of the fuel-oxidant reaction to form a solid slag that is captured by the filters in the housing that contains the gas generating composition. The fuel is a solid metal azide having greater than 60% by weight nitrogen. The oxidant is an alkali nitrate. The additive is a reactive form of silicon dioxide ($SiO_2$).

DETAILED DESCRIPTION OF THE PREFERRED EMBODIMENT

The components of the generating composition described above uses, preferably, sodium azide as the fuel. Sodium azide is 63% nitrogen by weight, a non-toxic gas. By practicing reasonable safety habits it can be comminuted and easily handled in solid-solid mixers. The oxidant is potassium nitrate, non-hygroscopic alkali nitrate obtainable in a high degree of purity and does not contain residual heavy metals at levels which could form explosive heavy metallic azides. Diotomaceous earth is used as a slagging agent to prevent the formation of a toxic aerosol as a by-product of the fuel-oxidant reaction. The slagging agent is a solid, consisting essentially of silicon dioxide. It possesses a large surface area, facilitating rapid combination with the product of the fuel-oxidant reaction, forming a complex sodium potassium silicate. The formed slag is easily arrested by the filtering system in the inflator.

For an effective gas generating reaction, particle size of the fuel and the oxidant must be reduced. Preferably, the particles should be in the range of 10 to 30 microns. The slagging agent should also be of a reduced particle size, preferably in the range of 5 to 10 microns and have a surface area of 3000–4000 $Cm^2/gm$.

The ingredients described above could be mixed effectively in mixers available in the industry for solids mixing, after comminuting them to the desired degree of fineness. Also, a suitable binder could be used to granulate the composition insuring a free flowing product for pelleting.

The method of assessing the gas generating composition for use in airbags has attracted the attention of manufacturers engaged in the development of this device. A standard method has been to fire the device into a static pressure tank of known volume and study the pressure-time variation, as well as the level of toxic residuals. The pressure-time study data can be correlated to its end use, such as the driver or the passenger side device. The pressure-time data referred to in this disclosure was compiled from tests occurring in a seventy (70) liter tank. The results set forth below can be correlated and compared to test situations where tanks of differing volumes are used.

The objectives and advantages of the invention become more apparent to those skilled in the art, as the invention is further disclosed in the examples to be given below:

EXAMPLE I

A mixture of sodium azide and potassium nitrate, both ground to a size of 15–20 microns and mixed with diatomaceous earth of particle size 5–10 microns and a surface area between 3000–4000 $Cm^2/gm$, when mixed in a weight percent proportion of 3:1:1 to 3.5:1:1 of respectively fuel, oxidizer, and slagging agent will give a propellant with a slope of 1.00–1.10 PSI per millisecond in the test tank mentioned earlier and can be used effectively for airbags used on the driver's side, where lower levels of maximum pressure are preferred.

EXAMPLE II

A mixture of sodium azide and potassium nitrate, both ground to a size of 20–30 microns and mixed with diatomaceous earth of particle size of 5–10 microns and 3000–4000 $Cm^2/gm$ surface area, in a weight percent proportion of 3:1:1, will give a propellant with a slope of 1.10–1.30 PSI per millisecond in the test tank mentioned earlier and can be effectively used on airbags for the drivers side, where higher maximum pressures are desired.

EXAMPLE III

A mixture of sodium azide and potassium nitrate, both ground to a size of 15–20 microns and mixed with diatomaceous earth, 5–10 microns in size of 3000–4000 $Cm^2/gm$ surface area in a weight percent proportion of 3.3:1:1, gives a propellant that gives propellant with a slope of 1.30–1.65 PSI per millisecond and can be effectively used in airbags for the passenger side, in combination with the propellant from Example 1.

EXAMPLE IV

The flow properties of propellants in examples I through III can be very much improved for the pelleting operations by adding 0.5 to 1.0% of flow improvement additives like Magnesium oxide and Aluminum oxide which are available commercially. Examples of such additives are Magnasol, made by Reagent Chemical and Research Inc. and Aluminum oxide made by Deguissa Corp.

The scope and ambit of the invention is not limited to the pressure-time slope mentioned earlier, for effective use in airbags, as the design of the housing and filter system may vary. The compositions mentioned in the examples can be made to give different pressure-time profiles. Factors that could be used for getting such different profiles are varying the particle size of the fuel and oxidant and using pellets with different geometry as some of the parameters which could be utilized.

We claim:

1. A gas generating composition comprising sodium azide, potassium nitrate, and silicon dioxide where the particle size of the sodium azide and potassium nitrate are between 10 and 20 microns and the particle size of the silicon dioxide is between 5 and 10 microns and wherein the ratios of sodium azide potassium nitrate and silicon dioxide varies by weight from 3:1:1 to 3.8:1:1, respectively.

2. The composition according to claim 1 further comprising the addition of magnesium oxide.

3. The composition according to claim 1 further comprising the addition of aluminum oxide.

* * * * *